United States Patent [19]

Nausedas et al.

[11] 4,277,930

[45] Jul. 14, 1981

[54] BAGS WICKETED ON A FLEXIBLE BINDING

[75] Inventors: Joseph A. Nausedas, Chicago; Harry P. Eichin, Western Springs, both of Ill.

[73] Assignee: Union Carbide Corporation, New York, N.Y.

[21] Appl. No.: 7,181

[22] Filed: Jan. 29, 1979

Related U.S. Application Data

[60] Division of Ser. No. 808,310, Jun. 20, 1977, which is a continuation of Ser. No. 698,847, Jun. 23, 1976, which is a continuation of Ser. No. 516,240, Oct. 18, 1974.

[51] Int. Cl.[3] ..... B65B 67/12

[52] U.S. Cl. ..... 53/396; 53/390

[58] Field of Search ..... 53/396, 459, 571, 572, 53/384, 390; 206/554; 271/168; 29/426; 221/312 A; 211/57.1; 248/100

[56] References Cited

U.S. PATENT DOCUMENTS

| | | | |
|---|---|---|---|
| 858,115 | 6/1907 | Stebbings | 211/57.1 |
| 2,564,900 | 8/1951 | Henriksen | 29/426 |
| 2,925,175 | 2/1960 | Williamson et al. . | |
| 3,184,055 | 5/1965 | Davis | 206/554 |
| 3,211,293 | 10/1965 | Tarnoff . | |
| 3,261,066 | 7/1966 | Chamberlin | 206/554 |
| 3,312,339 | 4/1967 | Miwon . | |
| 3,338,398 | 8/1967 | Altman, Jr. . | |
| 3,380,579 | 4/1968 | Pinto | 206/559 |
| 3,406,818 | 10/1968 | Barnett . | |
| 3,454,166 | 7/1969 | Dinges . | |
| 3,472,388 | 10/1969 | Blase . | |
| 3,490,195 | 1/1970 | Abramson | 53/572 X |
| 3,552,697 | 1/1971 | Pinto | 206/554 X |
| 3,738,482 | 6/1973 | Cwikla . | |
| 3,770,134 | 11/1973 | Kopcikevicius . | |

FOREIGN PATENT DOCUMENTS

| | | |
|---|---|---|
| 830887 | 1/1952 | Fed. Rep. of Germany . |
| 1320811 | 6/1973 | United Kingdom . |

*Primary Examiner*—John Sipos

*Attorney, Agent, or Firm*—Maurice W. Ryan

[57] ABSTRACT

A stack of flexible packaging bags, such as used in the meat packing industry in conjunction with automatic and semiautomatic packaging apparatus, made by assembling a multiplicity of flattened stacked wicket-holed bags on a flexible tubing binding threaded through the bag wicket holes to define a severable loop handle element, shank elements passing through the wicket holes in the stacked bags, and shank portion extensions adapted to secure the shank portions of the binding to wicket mounting means and to mount bag stack securing means.

2 Claims, 2 Drawing Figures

BAGS WICKETED ON A FLEXIBLE BINDING

Figure 1:
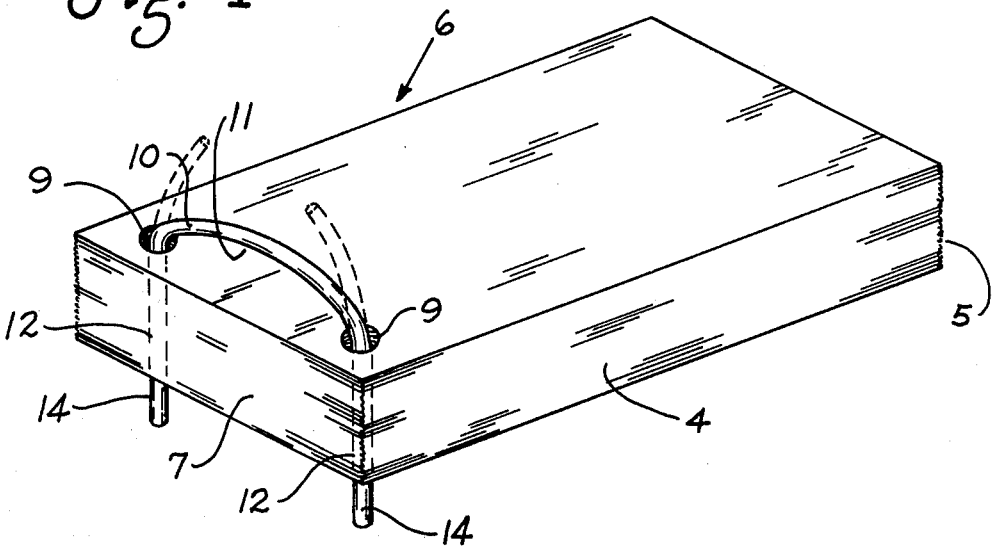

This application is a division of our prior U.S. application Ser. No. 808,310 filed June 20, 1977 which is a continuation of application Ser. No. 698,847 filed June 23, 1976 which is a continuation of application Ser. No. 516,240 filed Oct. 18, 1974.

This invention relates to a package article, particularly to a package of stacked, flexible sheet articles, and more particularly to a package or stack of flattened, stacked, wicket holed flexible packaging bags made of plastic or the like material, of the type customarily used in the meat packaging industry in conjunction with automatic and semiautomatic packaging apparatus.

Pakcaging operations in industry, particularly in the meat packing industry, involve the use of flexible plastic packaging sheets or bags held on wickets passing through wicket holes in the stacked sheet or bag supply for one at a time removal and utilization at a packing station. The modes of automatic and semiautomatic packaging which utilize such sheet materials and bags, and the criteria for such usages are discussed in U.S. Pat. No. 3,738,482 to Cwikla.

The packaging, handling, shipping, unpacking, and mounting for utilization of these sheets and bags, because of their slippery surfaces, presents many problems. The ensuing discussion will treat only of bags for purposes of simplification, but the discussion in general also applies to sheets. Polyethylene bags for such use, for instance, when shipped, as they customarily are, in loose bulk quantities, tend to slide into disorderly piles and are extremely difficult to handle. The invention described in the aforesaid patent to Cwikla, obviated these problems to some extent by providing a pre-wicketed bag stack but that solution presupposes a packaging station having wicket sockets to accept the wicket which comes with the pre-wicketed bag stack.

The desiderata of flattened, stacked, wicket holed, flexible plastic, slippery packaging bags then is that they be held bundled and neatly stacked, with their wicket holes in registration, as a unitary package, during packing, shipping, unpacking, and installation at a packing station, and that the arrangement to accomplish these ends be optimally flexible to accommodate various modes of bag installation and mounting at different packaging stations.

With this being the state of the art, the present invention was conceived and developed to provide a unitary stack or bundle of flexible plastic packaging bags with wicket holes all held nicely in registration and alignment by means of a flexible binding.

The present invention also provides a unitary stack of wicket holed flexible plastic packaging bags wherein the flexible binding holding the assembly of bags is also utilized as a carrying handle.

The invention further provides a stack of wicket-holed packaging bags wherein the flexible binding holding the bags may be severed at its carrying handle portion and utilized as a pair of wicket legs.

Another feature of the invention is the provision of binding shank elements of flexible tubing which can be readily slipped over wicket posts.

A still further and advantageous feature of the invention is in its provisions of a binding which securely holds the stacked bags during shipping and handling and readily permits their transfer to various other wicketing means.

Figure 2:
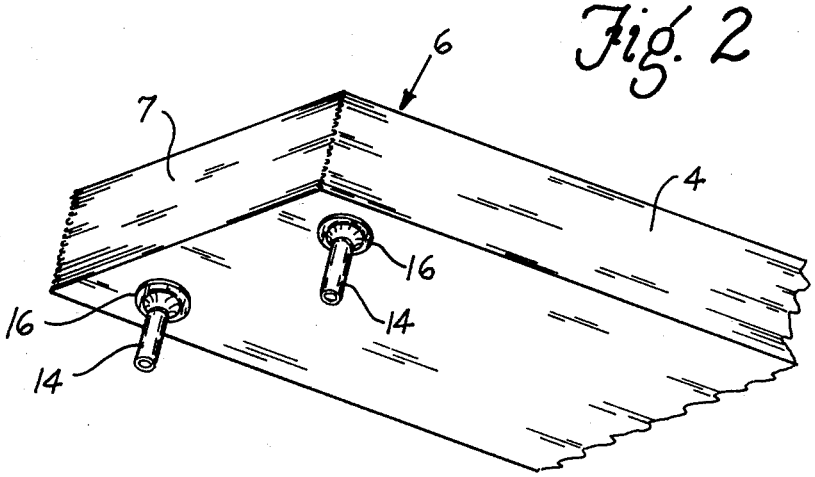

These and other features and advantages of the invention will become the more readily understood and appreciated from the ensuing detailed description and the drawings wherein:

FIG. 1 is an isometric view, looking from above, of a stack of bags held on a flexible binding according to the present invention, the position of the two pieces of flexible binding after severing being shown by dashed lines and FIG. 2 is an isometric view, looking from below, of the stack of bags of FIG. 1.

In general, the present invention comprehends a package article comprising, in combination, a stack of flattened flexible packaging sheets, each sheet having two wicket holes therethrough, said wicket holes being in substantial registration with the wicket holes in respectively contiguous sheets in the stack, an elongate flexible binding member extending through the wicket holes in the stacked sheets to form a hand grippable loop between the wicket holes of the topmost sheet of the stack and a shank extending from each of the wicket holes in the bottommost sheet of the stack, and means on each said shank to retain the sheets and the binding member.

Particular embodiments of package articles according to the invention comprise stacks of two-ply flattened, closed bottom, open mouth packaging bags.

The elongate flexible binding member is preferably a length of plastic tubing, and the means on the shanks to retain the sheets or bags on the binding member are preferably friction washers.

With reference to the drawings, there is shown generally a bundle or stack 6 of flattened flexible plastic packaging bags 4 each having a closed bottom end 5, an open mouth end 7, and wicket holes 9 through the flattened plies. The wicket holes 9 through the bags 4 are in substantial registration throughout the stack 6. An elongate flexible binding member 10, preferably a length of plastic tubing, is threaded through the wicket holes 9 as shown to form a hand grippable loop 11 between the wicket holes of the topmost bag of the stack. Shank elements 12 of the flexible binding member 10 are shown in place in the wicket holes 9, with shank extensions 14 extending from the bottommost bag 4 of the bag stack 6. The bags are held on the flexible binding 10 by means of friction washers 16, one on each shank extension 14, slid up snugly against the underside of the bottommost bag of the stack as shown in FIG. 2 of the drawings.

The bag stack package article according to the invention and as herein described and illustrated can be readily lifted by the loop 11 for placing into and removal from a shipping carton, for carrying to a packaging station for installation in a bag dispensing apparatus, and for any other necessary handling.

Bags bundled and bound on flexible tubing according to the invention can be readily transferred to rigid inverted U shaped wickets used in many automatic and semi-automatic packaging techniques. To effect such a transfer to a selected rigid inverted U shaped wicket, the friction washers 16 are removed from the shank extensions 14, the rigid wicket legs are slid into the open ends of the tubing binding member 10, the tubing and wicket legs are pulled up through the aligned wicket holes 9 in the bag stack 6 until the rigid wicket legs extend beyond the uppermost bag of the stack, and the tubing binding is slid off the wicket legs, leaving the bag stack aligned as before, but now on a rigid wicket.

Transfers to hollow tubing rigid wickets, where necessary, are accomplished in a similar manner but may be workably effected with either a solid or a tubular plastic binding element, the solid element being slid into the rigid tubular wicket leg and the tubular element being slipped either into or over such wicket leg.

The package article according to the invention is more advantageously used however in connection with bag holding platens having either wicket holes into which the shank extensions 14 are inserted or wicket posts over which tubular shank extensions 14 are slipped. In such arrangements, the flexible binding member 10 is severed at the midpoint of the hand grippable loop 11 and the severed sections serve as wicket posts holding the bags in readiness for one at a time removal from the stack.

In connection with such applications, the present invention is particularly and most advantageously used in conjunction with the Pivoted Wicket Bag Opening Dispenser of Nausedas, U.S. Pat. No. 3,918,589, Nov. 11, 1975, assigned to the same assignee as is this application. It is to be appreciated however that this invention is not limited to use only with the invention aforesaid.

EXAMPLE

A typical bundle of bags according to the present invention was made up of 200 bags of 0.04 mm. thick polyvinyldichloride tubular plastic film, cut and bottom sealed into flush cut bags, each of 41 cm. flatwidth by 76 cm. length, with 12.5 mm. wicket hole apertures spaced on 25 cm. centers adjacent the mouth end. A 40 cm. length of 0.95 cm. O.D. by 0.63 cm. I.D. flexible polyethylene tubing was threaded through the aligned wicket hole apertures and the bags were secured onto the tubing with 10 mm. friction washers disposed to leave about 3 cm. lengths as shank extensions. Bundles so made were tested and found consistently easy to handle in the process of carton packaging, unpackaging, dispensing station installations, and ultimate utilization of the bags, without any bundle breakage, spills, or other malfunctions.

Modes of practicing this invention other than those heretofore described, but within the spirit of the invention, may, in the light of this disclosure, occur to persons conversant with the art. It is therefore intended that the disclosure be taken as illustrative only, and not construed in any limiting sense.

What is claimed is:

1. In a continuous process for the successive packaging of individual articles in a series of articles delivered sequentially to a packaging station, the improvement comprising the steps of:

providing a stack of flattened flexible packaging sheets held assembled on an elongate flexible binding member extending through registered wicket holes in said sheets, said member defining a hand grippable severable loop between the wicket holes of the topmost sheet of said stack and a shank extending from each wicket hole in the bottommost sheet of the stack, mounting the stack of sheets on a sheet dispensing wicket base means arranged and disposed to secure the shank portions of the flexible binding member, severing the flexible binding member at a point on the hand grippable loop and thereby forming upwardly extending free-ended flexible wicket elements holding said sheets in readiness for one at a time removal, and removing the packaging sheets from the stack over said severed ends of the severed loop of the flexible binding member without tearing said sheets.

2. A method according to claim 1 wherein each unitary packaging sheet in the stack consists of a flattened closed bottom open top packaging bag.

* * * * *